United States Patent [19]

Sumitomo

[11] Patent Number: 4,753,079

[45] Date of Patent: Jun. 28, 1988

[54] EVAPORATING APPARATUS

[75] Inventor: Hiroyuki Sumitomo, Osaka, Japan

[73] Assignee: Hisaka Works, Limited, Osaka, Japan

[21] Appl. No.: 3,011

[22] Filed: Jan. 13, 1987

[30] Foreign Application Priority Data

Mar. 5, 1986 [JP] Japan ..... 61-47953

[51] Int. Cl.[4] ..... F01K 17/00; F01K 25/00

[52] U.S. Cl. ..... 60/676; 60/651; 60/671; 62/268; 122/407; 122/32

[58] Field of Search ..... 122/34, 36, 407, 483, 122/32; 62/270, 268; 159/17.1, 17.2, 17.3, DIG. 16; 60/676, 651, 671

[56] References Cited

U.S. PATENT DOCUMENTS 2,183,821 12/1939 Nelson ..... 62/270

4,321,801 3/1982 Collard ..... 62/268

*Primary Examiner*—Albert W. Davis, Jr.

*Attorney, Agent, or Firm*—Armstrong, Nikaido, Marmelstein & Kubovcik

[57] ABSTRACT

An evaporating apparatus comprising a high temperature side evaporator and a low temperature side evaporator connected in series in a flowing direction of a heat source, a first and second pipe line for directing fluid being evaporated therethrough, and an ejector having a suction inlet and a discharge outlet of drive steam and an induction port of steam being sucked, wherein the first pipe line is linked through the high temperature side evaporator to the suction inlet of the ejector, and the second pipe line is branched from the first pipe line at the upstream side of the hot temperature side evaporator, and linked through the low temperature side evaporator to the induction port of the ejector.

1 Claim, 1 Drawing Sheet

EVAPORATING APPARATUS

BACKGROUND OF THE INVENTION

1. Field of the Invention

The present invention relates to an evaporating apparatus for liquid having a low boiling point utilizing an ejector which is effective in a heat recovery system or the like having a low thermal drop.

2. Prior Art

A heat recovery system employing a Rankine cycle as an effective utilization method of waste heat is already well known. A system designed to recover the waste heat from a heat source such as waste water from plants as a power is disclosed, for example, in Japanese Patent Application laid open under No. 60-144594. The prior art system is constructed by connecting an evaporator 2 for heating and evaporating working fluid such as fluorine gas with the waste heat as the heat source, a positive displacement expander such as a screw expander or a steam turbine 4 which is driven by working fluid vapor having a high temperature and pressure and produced in the evaporator 2, a condenser 6 for cooling and condensing the working fluid vapor reduced to a low pressure and exhausted from the steam turbine 4 after completing the work, and a pump 8 for circulating the working fluid in a closed loop, and output shaft of the steam turbine is coupled to the load 10 such as a generator or pump according to the utilization of a recovered thermal energy.

An evaporator heats working fluid with heat from heat source water and supplies working fluid vapor having a constant temperature. By the way, when saturated aqueous ammonia $NH_3$ of 18° C. is supplied to the evaporator, while sea water of 24° C. is fed as a heat source by 380 $m^3/H$, the working fluid vapor of 18° C., 8.19 ata is produced.

SUMMARY OF THE INVENTION

The present invention is directed to provide an evaporating apparatus capable of producing vapor having a higher pressure.

An evaporating apparatus in accordance with the present invention includes a high temperature side evaporator and a low temperature side evaporator connected together in series in a flowing direction of heat source, a first and second pipe line for directing liquid being evaporated therethrough, and an ejector having a suction inlet and discharge outlet of the drive steam and an induction port of steam being sucked. The first pipe line is linked through the high temperature side evaporator to the suction inlet of the ejector. The second pipe line is branched from the first pipe line at the upstream side of the high temperature side evaporator, and linked through the low temperature side evaporator to the induction port of the ejector.

The liquid being evaporated is proceeded through a first and second pipe line. The liquid flowing through the first pipe line takes heat from a heat source to evaporate in an evaporator. The produced steam is directed to a suction inlet of an ejector along the first pipe line. The liquid flowing through the second pipe line takes heat again from the heat source, which is reduced to a lower temperature by emitting certain heat in the high temperature side evaporator as hereinbefore described to evaporate in the low temperature side evaporator. The steam having a relatively lower pressure than that produced in the high temperature side evaporator, is led through the second pipe line to the induction port of the ejector. The drive steam is effected in the ejector by the high pressure steam from the high temperature side evaporator. That is, by the pressure difference of high pressure steam flowing from the suction inlet to the discharge outlet of the ejector, low pressure steam from the low temperature said evaporator is sucked into the induction port of the ejector. The high pressure steam and low pressure steam are mixed to produced mixed steam having a higher pressure than the low pressure steam at the discharge outlet of the ejector.

According to the present invention, regardless of the same condition on the sides of heat source and liquid being evaporated, ultimately the vapor having a higher pressure may be obtained. In other words, a more effective evaporating apparatus can be provided. Thus, it is contributive to improve the efficiency when applied in a heat recovery system or the like of a low thermal drop, utilizing working fluid having a particularly lower boiling point on the basis of a Rankine cycle.

BRIEF DESCRIPTION OF THE INVENTION

DESCRIPTION OF THE PREFERRED EMBODIMENT

Figure 1:
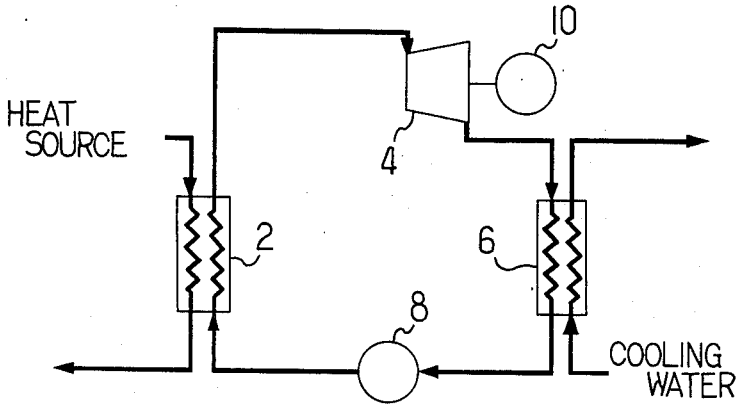
FIG. 1 is a block diagram of a heat recovery system.

Referring first to FIG. 1, a heat recovery system in which an evaporating apparatus of the invention is used is constructed by connecting an evaporator 2 for heating and evaporating working fluid such as fluorine gas with the waste heat as the heat source, a positive displacement expander such as a screw expander or a steam turbine 4 which is driven by working fluid vapor having a high temperature and pressure and produced in the evaporator 2, a condensor 6 for cooling and condensing the working fluid vapor reduced to a low pressure and exhausted from the steam turbine 4 after completing the work, and a pump 8 for circulating the working fluid in a closed loop, an output shaft of the steam turbine is coupled to the load 10 such as a generator or pump according to the utilization of a recovered thermal energy.

Figure 2:
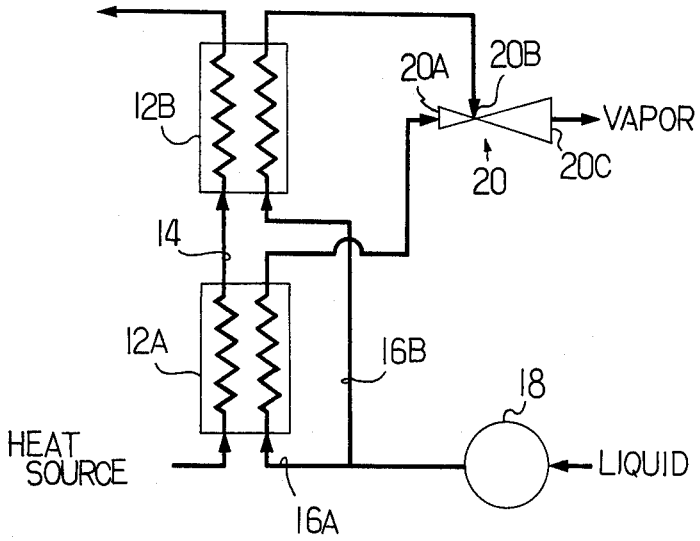
FIG. 2 is a block diagram of an evaporating apparatus embodying the present invention.

Referring now to FIG. 2 showing an evaporating apparatus embodying the present invention shown in FIG. 1, two evaporators (12A) (12B) are connected in series relative to a heat source or in a flowing direction of the heat source. That is, heat source water first enters into the high temperature side evaporator (12A) through a pipe line (14), then proceeds to the low temperature side evaporator (12B). To the high temperature side evaporator (12A), there is connected a first pipe line (16A) for directing liquid being evaporated therethrough, which is linked from a liquid circulating pump (18) to a suction inlet (20A) of an ejector (20) through the high temperature side evaporator (12A). To the low temperature side evaporator (12B), there is connected another pipe line or second pipe line (16B) branched from the aforementioned first pipe line (16A) at the upstream side of the high temperature side evaporator (12A), the second pipe line (16B) is linked from the low temperature side evaporator (12B) to an induction port (20B) of the ejector (20).

Now, operation of the embodiment will be described. As previously described in connection with the prior art, here, too, sea water of 24° C. is supplied as heat source by 380 $m^3/H$, while saturated aqueous ammonia $NH_3$ of 18° C. is fed to the high temperature and low temperature side evaporators (12A) (12B) by the liquid circulating pump (18). The sea water first gives heat to ammonia flowing through the first pipe line (16A) in the high temperature side evaporator (12A) and becomes 21° C., then in the low temperature side evaporator (12B), it gives heat to the ammonia in the second pipe line (16B) and ultimately drops to 19° C.

Ammonia being evaporated takes heat from the sea water in the hot temperature side evaporator (12A), and proceeds to the suction inlet (20*a*) of the ejector (20) as changing into ammonia vapor of 20° C., 8.74 ata. The aqueous ammonia directed to the low temperature side evaporator (12B), takes heat from the sea water and proceeds to the induction port (20B) of the ejector (20) as changing into ammonia vapor of 18° C., 8.19 ata. Then the high pressure vapor from the high pressure side evaporator (12A) sucks the low pressure vapor from the low temperature side evaporator (12B) through the induction port (20B) of the ejector (20), by a pressure difference produced when flowing from the suction inlet (20A) to the discharge outlet (20C) of the ejector (20), and mixes therewith to ultimately form the ammonia vapor of about 18.7° C., 8.35 ata after being increased above the pressure of low pressure vapor (8.19 ata) during the boosting process thereafter.

In case of the aforementioned embodiment shown in the drawing, the vapor having a pressure higher than in the case of the prior art described previously by 0.16 ata may be obtained.

What is claimed is:

1. In a heat recovery system comprising in combination forming a closed loop, an evaporator means for converting a working fluid into vapor with a waste heat, a steam engine means for driving a load with the vapor produced in the evaporator means, a condensor means for liquefying the vapor coming out of the steam engine means, and a pump means for circulating the working fluid in the closed loop, the improvement of the evaporator means comprising a high temperature side evaporator and a low temperature side evaporator connected in series in a flowing direction of a heat source, a first and second pipe line for directing fluid being evaporated therethrough, and an ejector having a suction inlet and a discharge outlet of drive steam and an induction port of steam being sucked, wherein the first pipe line is linked through the high temperature side evaporator to the suction inlet of the ejector, and the second pipe line is branched from the first pipe line at the upstream side of the high temperature side evaporator, and linked through the low temperature side evaporator to the induction port of the ejector.

* * * * *